US008240507B2

(12) United States Patent
Breeser et al.

(10) Patent No.: US 8,240,507 B2
(45) Date of Patent: Aug. 14, 2012

(54) SEAL-RETAINING VALVE FOR FLUID METERING DEVICE

(75) Inventors: David L. Breeser, Minneapolis, MN (US); Daniel J. Rogers, Lindstrom, MN (US); John C. Holman, Ham Lake, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 1090 days.

(21) Appl. No.: 12/214,699

(22) Filed: Jun. 20, 2008

(65) Prior Publication Data

US 2009/0314980 A1 Dec. 24, 2009

(51) Int. Cl.
*B67B 1/00* (2006.01)

(52) U.S. Cl. ..... 222/20; 137/215; 137/625.33; 222/22; 222/72; 222/74; 222/153.14

(58) Field of Classification Search ..... 141/59, 141/392, 215, 625.33, 325.34; 222/14–22, 222/71–74, 153.01–153.14, 560, 561, 557; 137/59, 392, 215, 625.33, 325.34
See application file for complete search history.

(56) References Cited

U.S. PATENT DOCUMENTS

| | | | | |
|---|---|---|---|---|
| 951,267 | A * | 3/1910 | Cator | 251/205 |
| 4,941,507 | A * | 7/1990 | Shenn | 137/625.37 |
| 6,659,306 | B2 * | 12/2003 | Boyle et al. | 222/1 |
| 7,082,972 | B1 | 8/2006 | Healy | |

FOREIGN PATENT DOCUMENTS

| | | | |
|---|---|---|---|
| CH | 131 428 | A | 2/1929 |
| DE | 134 683 | C | 9/1899 |
| JP | 09096371 | | 8/1997 |
| JP | 2001058697 | A | 3/2001 |
| KR | 19990056322 | A | 7/1999 |
| KR | 20070105420 | A | 10/2007 |
| WO | WO9614104 | A1 | 5/1996 |

OTHER PUBLICATIONS

The Official Search Report and Written Opinion of the International Searching Authority in counterpart International Application No. PCT/US2009/003706 filed Jun. 22, 2009.
Extended European Search Report of EP Application No. 09767114.3, filed Jun. 22, 2009.

* cited by examiner

*Primary Examiner* — Kevin P Shaver
*Assistant Examiner* — Melvin Cartagena
(74) *Attorney, Agent, or Firm* — Kinney & Lange, P.A.

(57) ABSTRACT

A valve comprises a valve cartridge, a valve stem and a valve seal. The valve cartridge comprises a generally cylindrical cartridge body, a bore extending longitudinally through the cartridge body, and an outlet passage and intermittent inlet passages extending through a side wall of the cartridge body to intersect the bore. The valve stem comprises an elongate body configured to slide within the bore, and a neck and a seal channel circumscribing the elongate body. The valve seal is seated within the seal channel. The valve stem slides within the bore to move the seal channel past the inlet passages. Portions of the cartridge body between the inlet passages retain the valve seal within the valve channel until the inlet passages are open to the neck. In one embodiment, the inlet passages form a crenelated edge. In another embodiment, the inlet passages form a ported end.

22 Claims, 8 Drawing Sheets

SEAL-RETAINING VALVE FOR FLUID METERING DEVICE

CROSS-REFERENCE TO RELATED APPLICATION(S)

The present application is related to the following co-pending applications filed on the same day as this application: "INVOLUTE GEAR TEETH FOR FLUID METERING DEVICE" by inventor D. Breeser (U.S. patent application Ser. No. 12/214,669, and "TRIGGER RELEASE MECHANISM FOR FLUID METERING DEVICE" by inventor D. Breeser (U.S. patent application Ser. No. 12/214,698.

BACKGROUND

The present invention is directed toward flow control valves and more particularly to linearly actuated valves used in fluid dispensing devices. Hand-held devices are often used to dispense measured amounts of fluid from bulk containers. For example, automotive service stations frequently use hand-held meters to dispense small quantities of lubricating oil from large drums into automotive engines. Such hand-held meters and other similar fluid dispensing devices typically include a valve having a linearly actuated valve stem that rides within a valve cartridge. The valve cartridge is fluidly connected to a source of pressurized fluid within the device, while the valve stem is actuated by an operator to regulate pressurized fluid flow through the valve cartridge. The valve stem is typically provided with a seal, such as an O-ring, that prevents fluid from leaking through the valve when the valve stem is in a closed position. In operation, however, the seal can become unseated, particularly when the operator abruptly actuates the valve stem under high pressures, and pushed into the valve cartridge. The unseated seal permits fluid to leak through the valve, as well as disrupts flow of dispensed fluid. As such, the precision of the dispensing device is adversely affected. Subsequently, it becomes necessary to disassemble the fluid dispensing device and the valve to retrieve and reseat or replace the seal, interrupting operations utilizing the fluid-dispensing device. There is, therefore, a need for an improved valve design that solves these and other problems in linearly actuated valves and fluid dispensing devices.

SUMMARY

The present invention is directed to a valve having a seal-retaining feature. The valve comprises a valve cartridge, a valve stem and a valve seal. The valve cartridge comprises a generally cylindrical cartridge body, a bore extending longitudinally through the cartridge body, and an outlet passage and intermittent inlet passages extending through a side wall of the cartridge body to intersect the bore. The valve stem comprises an elongate body configured to slide within the bore, and a neck and a seal channel circumscribing the elongate body. The valve seal is seated within the seal channel. The valve stem slides within the bore to move the seal channel past the inlet passages. Portions of the cartridge body between the inlet passages retain the valve seal within the valve channel until the inlet passages are open to the neck. In one embodiment, the inlet passages form a crenelated edge having a plurality of embrasures and merlons. In another embodiment, the inlet passages form a ported end having a plurality of bores.

DETAILED DESCRIPTION

Figure 1:
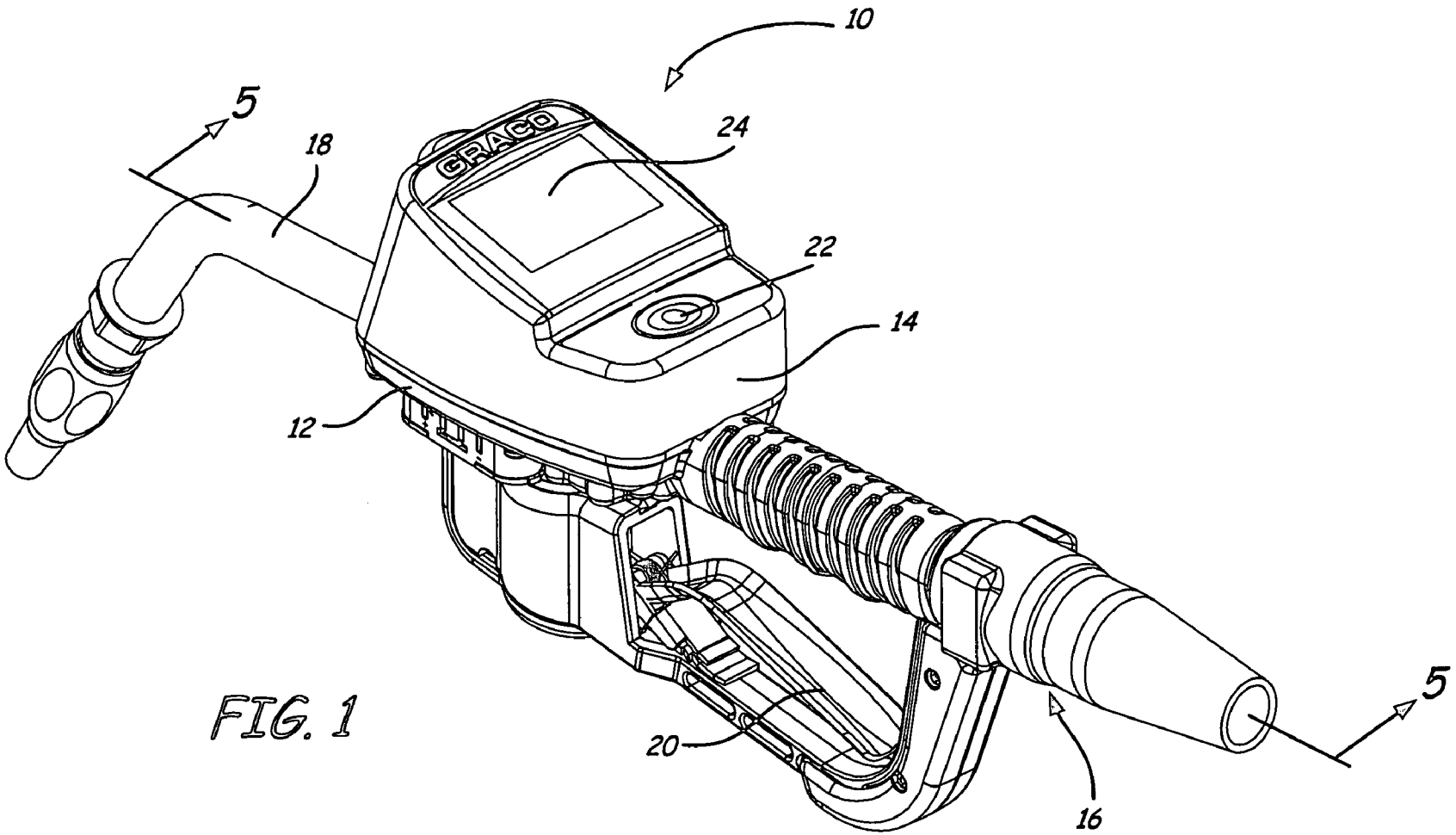
FIG. 1 shows a perspective view of a hand-held fluid dispensing device in which a seal-retaining valve of the present invention is used.

FIG. 1 shows a perspective view of hand-held fluid dispensing device 10 in which a seal-retaining valve of the present invention is used to limit leakage of the fluid from device 10. Dispensing device 10 includes platform 12, cover 14, high pressure fluid coupling 16, dispensing tube 18, trigger lever 20, user interface 22 and display 24. Dispensing device 10 permits fluid stored in a large-volume container to be distributed in smaller volumes in a convenient manner. For example, in one embodiment, dispensing device 10 comprises a meter used in lubrication shops to deliver small quantities of lubricating oil from a storage drum to a vehicle engine. Coupling 16 is connected to the large-volume container through a fluid handling hose (not shown), which is pressurized using, for example, an air operated pump. The length of the hose enables device 10 to conveniently reach locations to which it is impractical to move the large-volume container. Dispensing tube 18 is configured to be easily positioned within an opening of a small-volume container, such as an engine crankcase, into which a measured amount of the fluid is to be dispensed. Trigger lever 20 is manipulated by an operator to dispense fluid from the large-volume container to the small-volume container at dispensing tube 18. User interface 22 and display 24, which are connected to electronics within cover 14, assist the operator in monitoring dispensed fluid quantity, processing job orders, billing, collecting data and the like. The seal-retaining valve of the present invention, which is mounted to platform 12 under cover 14, interacts with trigger lever 20 to permit precise amounts of fluid to be dispensed without leakage or waste.

Figure 2:
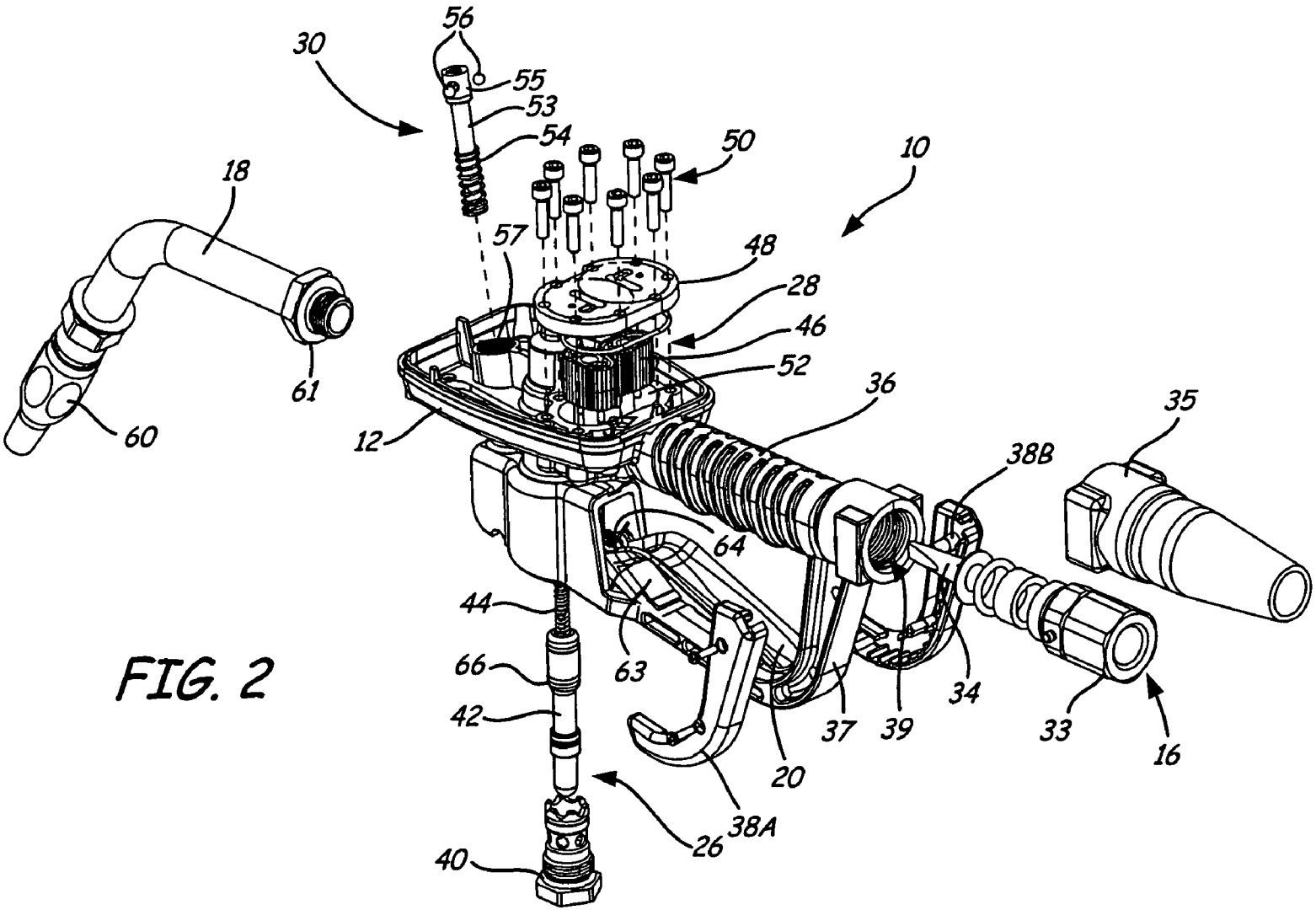
FIG. 2 shows a rearward exploded view of the hand-held fluid dispensing device of FIG. 1 showing a seal retaining valve of the present invention.
Figure 3:
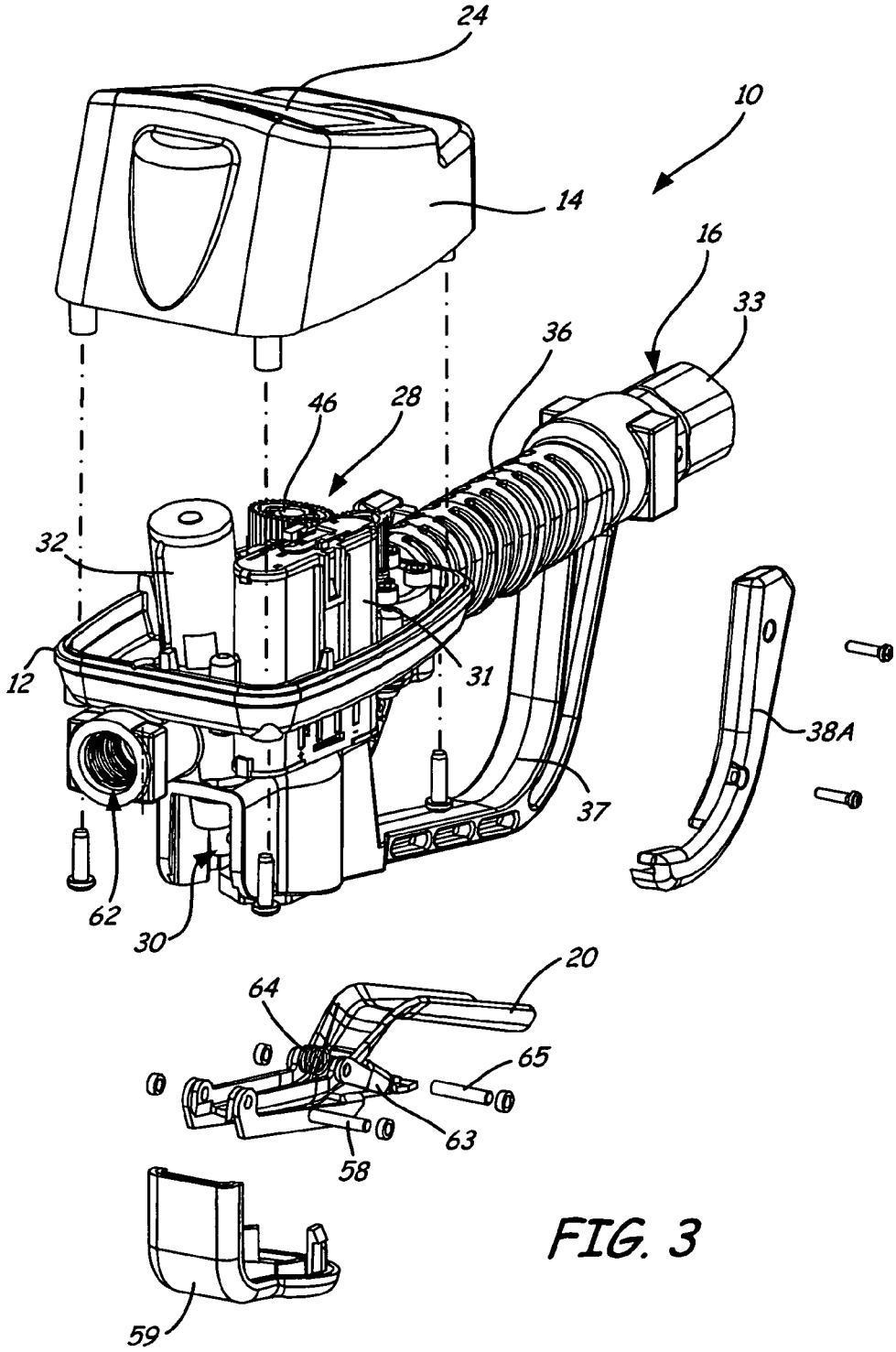
FIG. 3 shows a forward exploded view of the hand-held fluid dispensing device of FIG. 1.

FIGS. 2 and 3 show exploded views of dispensing device 10 of FIG. 1. FIG. 2 shows a rearward view of device 10 in which seal-retaining valve 26, flow meter 28 and trigger release 30 are shown. FIG. 3 shows a forward view of device 10 in which cover 14, flow meter 28, trigger release 30, battery 31 and solenoid 32 are shown. Fluid coupling 16, which includes swivel fastener 33, filter 34 and hose shroud 35, is connected to handle portion 36 of platform 12. Specifically, external threads on fastener 33 join with internal threads within high-pressure fluid passage 39, inside of handle portion 36. Handle portion 36 includes trigger guard 37, which includes pads 38A and 38B, to prevent accidental actuation of valve 26. Valve 26, which includes valve cartridge 40, valve stem 42 and valve spring 44, is positioned within platform 12 to interrupt flow between passage 39 and tube 18. Flow meter 28 includes gear set 46, cover 48 and fasteners 50. Gear set 46 is positioned within gear box 52 to engage fluid flowing between coupling 16 and valve 26. Gear box 52 is sealed with cover 48, which is secured with fasteners 50. Trigger release 30, which includes trip rod 53, spring 54, collar 55 and bearings 56, is positioned within bore 57, at the base of which trip rod 53 connects to trigger lever 20. Trigger lever 20 is joined to trip rod 53 with pin 58 to form a pivoting connection, which is enclosed within platform 12 by guard 59. Trigger lever 20 extends through platform 12 between handle portion 36 and trigger guard 37. Dispensing tube 18, which includes nozzle 60 and coupling 61, is connected to low pressure fluid passage 62 within platform 12. Specifically, external threads on coupling 61 join with internal threads within low pressure fluid passage 62.

Trigger lever 20 actuates seal-retaining valve 26 to permit fluid to be dispensed over a range of rates; the further trigger lever 20 is displaced, the more fluid is dispensed at tube 18. Trigger lever 20 can be maintained in an actuated position such that valve 26 remains open using trigger lock 63 and lock spring 64, which are joined to trigger lever 20 with pin 65. In conjunction with meter electronics, flow meter 28 monitors the rate at which the fluid flows through valve 26 to permit precise quantities of fluid to be accurately dispended by actuation of trigger lever 20. Also in conjunction with meter electronics, trigger release 30 prevents over-dispensing and reduces spills by disabling trigger lever 20 after a set amount of fluid has been dispensed. Thus, fluid dispensing device 10 enables the use of bulk storage, metered distribution and flow controls to reduce waste fluid and maintain greater control over fluid inventories. Valve 26 of device 10 is sized to dispense a high-volumetric output of fluid, such as approximately 14 gpm (gallons per minute) [~883.6 cc/s (cubic centimeters per second)] or more, which is typically achieved using high fluid pressures. High fluid pressures enable dispensing device 10 to more rapidly dispense fluid to save time, and to more easily dispense highly viscous fluids. Seal-retaining valve 26 of the present invention includes features that prevent pressurized flow of fluid through device 10 from unseating valve seal 66 during operation of device 10. Proper seating and retention of valve seal 66 reduces leakage of fluid through device 10, thereby improving the accuracy of dispensing device 10 and reducing wasted fluid.

Figure 4:
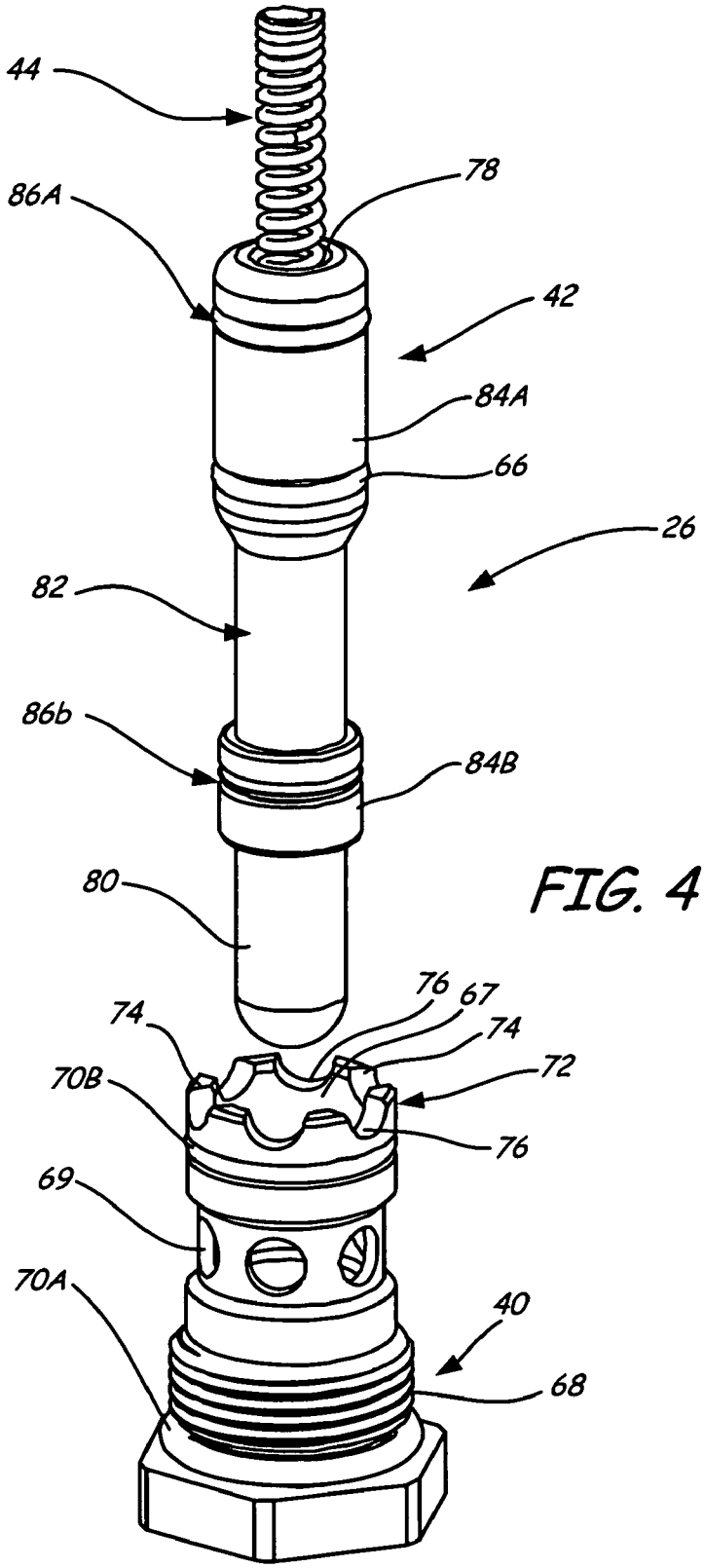
FIG. 4 shows an exploded perspective view of the seal-retaining valve of FIG. 2 showing a castle-top valve cartridge, a valve stem and a valve spring.

FIG. 4 shows an exploded view of valve 26 including valve cartridge 40, valve stem 42, valve spring 44 and valve seal 66. Valve cartridge 40 comprises a generally cylindrical body having receiving bore 67, external threads 68, discharge bores 69, cartridge seals 70A and 70B, and castle-top 72. Castle-top 72 comprises a crenelated edge having merlons (or flanges) 74 and embrasures (or scallops) 76. In the embodiment shown, embrasures 76 comprise semi-circular cutouts from an end of the body of cartridge 40 that form side inlet passages into bore 67. Merlons 74 comprise the portion of the body of cartridge 40 that projects between embrasures 76 and have curved side surfaces and a flat top surface. Thus, the crenelated edge comprises a wave-like pattern having truncated crests. In other embodiments, castle-top 72 may have other geometries, such as described with respect to FIG. 7, that produce intermittent inlet passages through a side wall of valve cartridge 40 near an end of the cylindrical body. Bores 69 comprise a plurality of discharge or outlet passages that allow fluid permitted to enter bore 67 by valve stem 42 to leave valve 26.

Valve stem 42 comprises a generally cylindrical body having spring bore 78, actuation portion 80, dispensing portion 82, first seal portion 84A, second seal portion 84B, first stem seal 86A, second stem seal 86B and valve seal 66. Seal spring 44 is configured to loosely fit within spring bore 78 of valve stem 42, while valve stem 42 is configured to tightly fit within receiving bore 67 of valve cartridge 40. Particularly, first and second seal portions 84A and 84B have diameters that fit flush within bore 67, flanking discharge bores 69. Seal portions 84A and 84B, however, are not so tightly fit into receiving bore 67 to prevent fluid flow between valve stem 42 and valve cartridge 40. As such, second stem seal 86B and valve seal 66, which are provided in seal channels circumscribing valve stem 42, seal dispensing portion 82 within valve cartridge 40. First stem seal 86A is also disposed within a seal channel and seals valve stem within platform 12. Dispensing portion 82 comprises a neck positioned between seal portions 84A and 84B and includes radially inwardly recessed surfaces from seal portions 84A and 84B to form a discharge port between valve stem 42 and valve cartridge 40.

Using external threads 68, valve cartridge 40 is configured to connect to platform 12 of dispensing device 10, while cartridge seals 70A and 70B seal the connection. Installed as such, valve spring 44 pushes against platform 12 to bias valve stem 42 into valve cartridge 40. Merlons 74 maintain valve seal 66 seated against valve stem 42 when trigger lever 20 actuates valve 26.

Figure 5:
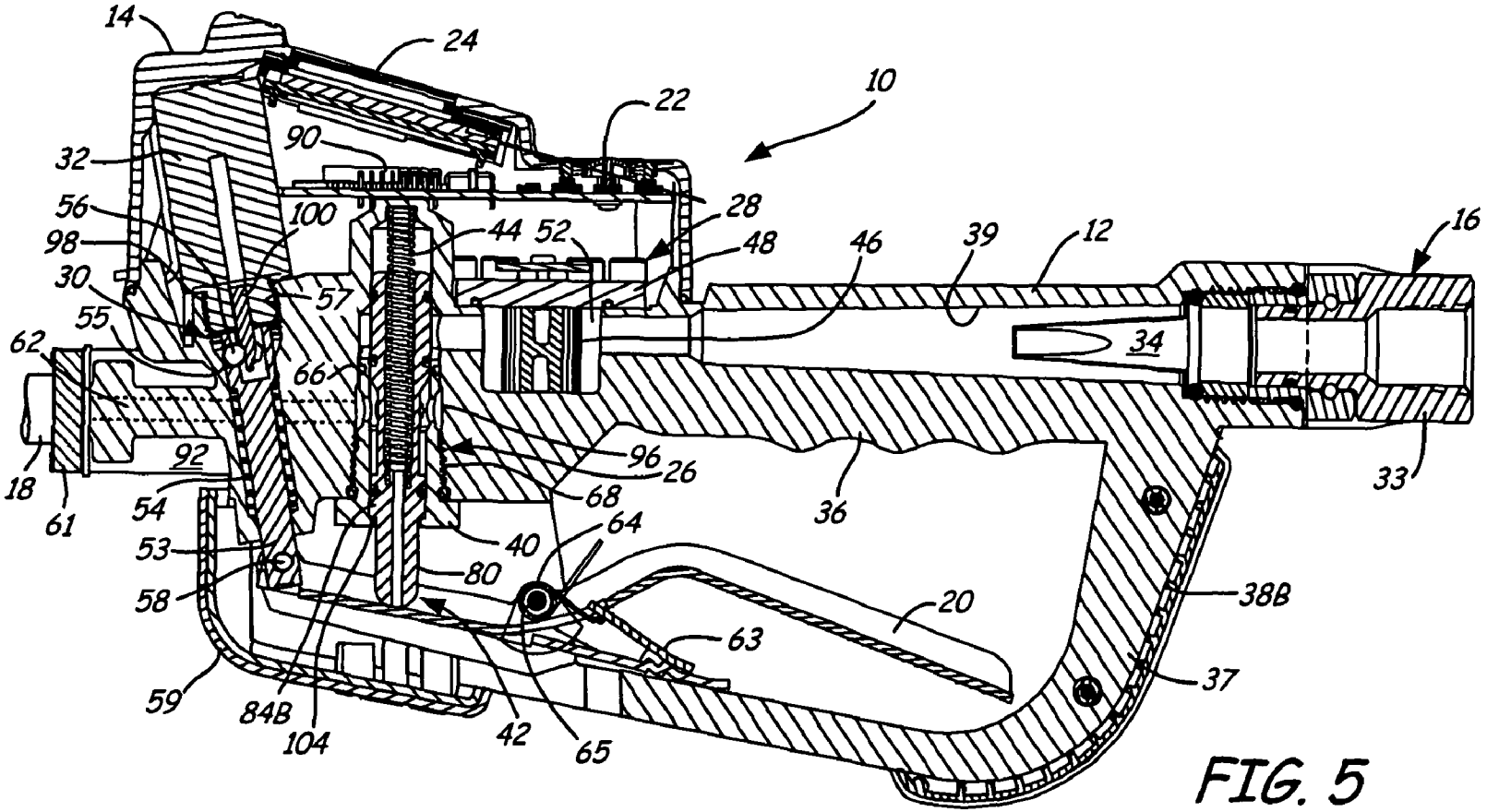
FIG. 5 shows a cross sectional view of the hand-held fluid dispensing device of FIG. 1 having a castle-top valve of the present invention.

FIG. 5 shows a cross section of fluid dispensing device 10 taken at section 5-5 of FIG. 1. Dispensing device 10 includes platform 12, cover 14, fluid coupling 16, dispensing tube 18, trigger lever 20, user interface 22, display 24, seal-retaining valve 26, flow meter 28, trigger release 30 and electronics 90. Platform 12 includes handle portion 36, which includes high-pressure fluid passage 39, and dispensing portion 92, which includes low-pressure fluid passage 62 (which is shown in hidden lines in FIG. 5 and is visible behind dispensing portion 92 in FIG. 3). High-pressure fluid passage 39 is in fluid communication with low-pressure fluid passage 62 through valve 26 to conduct fluid from coupling 16 to dispensing tube 18. High-pressure fluid passage 39 extends centrally through platform 12 within handle portion 36 and intersects valve 26. Low-pressure fluid passage 62 extends tangentially from valve 26, past bore 57 to dispensing tube 18, parallel to high-pressure fluid passage 39. Fluid coupling 16 is connected to an upstream end of fluid passage 39 through a threaded engagement. Gears 46 of flow meter 28 are disposed within gear box 52 positioned within a middle portion of passage 39. Gear box 52 is covered and sealed by lid 48. Seal-retaining valve 26 and trigger release 30 are disposed within bores 96 and 57, respectively, which extend into platform 12. Bore 57 extends into platform 12 at a slight angle from vertical with respect to passage 39, and does not intersect high-pressure fluid passage 39 or low-pressure fluid passage 62. Valve bore 96 extends approximately transversely into platform 12 to approximately perpendicularly intersect high-pressure fluid passage 39. An upper portion of bore 96 connects to the downstream end of passage 39, and a lower portion of bore 96 connects to the upstream end of passage 62. Valve 26 is positioned within bore 96 to regulate flow between passage 39 and passage 62. Trigger release 30 includes solenoid 32, trip rod 53, spring 54, collar 55, bearing 56, neck 98, plunger pin 100, and is configured to disable trigger lever 20 after a threshold amount of fluid has passed through meter 28. Coupling 61 is connected to a downstream end of passage 62 to guide fluid from device 10 through dispensing tube 18.

With valve spring 44 inserted into valve stem 42, and valve stem 42 inserted into valve cartridge 40, external threads 68 of valve cartridge 40 are threaded into bore 96 within platform 12. Inserted as such, valve spring 44 engages a dead-end of bore 96 within platform 12 and is compressed to bias valve stem 42 toward valve cartridge 40. Valve cartridge 40 includes lip 104 that engages seal portion 84B of valve stem 42 to prevent valve stem 42 from passing through valve cartridge 40. Seals 70A and 70B (FIG. 4) seal a lower end of bore 96 against valve cartridge 40, while seal 86A (FIG. 4) seals an upper end of bore 96 against valve stem 42. Actuation portion 80 of valve stem 42 extends from receiving bore 67 (FIG. 4) in valve cartridge 40 to engage trigger lever 20. Trigger lever 20 connects to trip rod 53 of trigger release 30 at pin 58, and extends laterally across platform 12, contacts activation portion 80 of valve stem 42, and continues laterally across handle portion 36.

From pin 58, trip rod 53 extends up into bore 57 so that collar 55 engages bearings 56. Bearings 56 are positioned within bearing bores within an upper portion of collar 55. Bearing 56 comprises one of three bearings equally spaced within collar 55. Neck 98 is threaded into bore 57 to join solenoid 32 with platform 12 such that pin 100 is extendable into bore 57. Solenoid 32 comprises a two way electromagnetic device that is activated by electronics 90 to alternate the position of pin 100 between being withdrawn into solenoid 32 and being extended into bore 57. In one embodiment, solenoid 32 comprises a latching solenoid as described in U.S. Pat. No. 6,392,516 by Ward et al. and assigned to TLX Technologies, Waukesha, Wis. When pin 100 is extended into bore 57 by solenoid 32, pin 100 engages bearings 56 and pushes bearings 56 into collar 55 and against the walls of bore 57. Bearings 56 are thus wedged between pin 100 and bore 57, and trip rod 53 is prevented from moving downward by bearings 56. When pin 100 is withdrawn from bore 57, bearings 56 are permitted to disengage collar 55 and trip rod 53 is permitted to slide within bore 57. With pin 100 extended into bore 57, trigger lever 20 can be actuated, e.g. brought toward handle portion 36, by an operator to pivot about pin 58 and push valve stem 42 into valve cartridge 40, allowing fluid to flow into low-pressure fluid passage 62 from high-pressure fluid passage 39. Trigger lock 63 and lock spring 64 can be employed to retain trigger lever 20 in a position to maintain valve 26 opened.

Trigger release 30 is actuated by electronics 90 to disengage trigger lever 20 after a set amount of fluid has passed through valve 26, as detected by meter 28. Solenoid 32 is connected to electronics 90, which includes software, circuitry and other components that are programmable to control device 10. For example, using interface 22 and display 24, an operator can program device 10 to dispense a preset volume of fluid. Additionally, in other embodiments, electronics 90 includes other components for communicating over a wireless network or radio network such that device 10 can send and receive information, such as work orders and fluid consumption, to and from a computer system. Device 10 also includes battery 31 (FIG. 3) for operating interface 22, display 24, electronics 90 and any other electrical component of device 10. After the preset volume of fluid is dispensed from device 10, solenoid 32 is activated to withdraw pin 100 from bearings 56. As such, trip rod 53 is released from pin 100 and is free to traverse within bore 57. Valve spring 44 pushes valve stem 42 and trigger lever 20 down to withdrawal trip rod 53 from bore 57 and close valve 26, respectively. Thus, trigger release 30 facilitates automated dispensing of the fluid and prevents over-dispensing and spilling of the fluid. Spring 54, which is biased within bore 57 between platform 12 and collar 55, returns trip rod 53 to neck 98 for reconnection with pin 100 and disengages trigger lock 63 such that trigger lever 20 is reset to perform another filling operation.

The ability of device 10 to precisely dispense fluid depends on the ability of electronics 90 to activate trigger release 30 after the pre-set volume of fluid is dispensed. Further explanation of trigger release 30 is found in the aforementioned co-pending application entitled "TRIGGER RELEASE MECHANISM FOR FLUID METERING DEVICE" which is herein incorporated by reference. The accuracy of trigger release 30 depends on the accuracy with which meter 28 is able to detect fluid flow through passage 39. Further explanation of meter 28 is found in the aforementioned co-pending application entitled "INVOLUTE GEAR TEETH FOR FLUID METERING DEVICE" which is herein incorporated by reference. The accuracy of trigger release 30 and meter 28 depend on the ability of valve 26 to cease fluid flow between passage 39 and passage 62 when closed. Seal-retaining valve 26 of the present invention prevents leakage of fluid through valve 26 by maintaining seal 66 seated against valve stem 42. In the embodiment shown, valve 26 includes castle-top valve cartridge 40 having crenelated edge 72 that pushes seal 66 against valve stem 42, while also allowing fluid to enter valve cartridge 40.

Figure 6A:
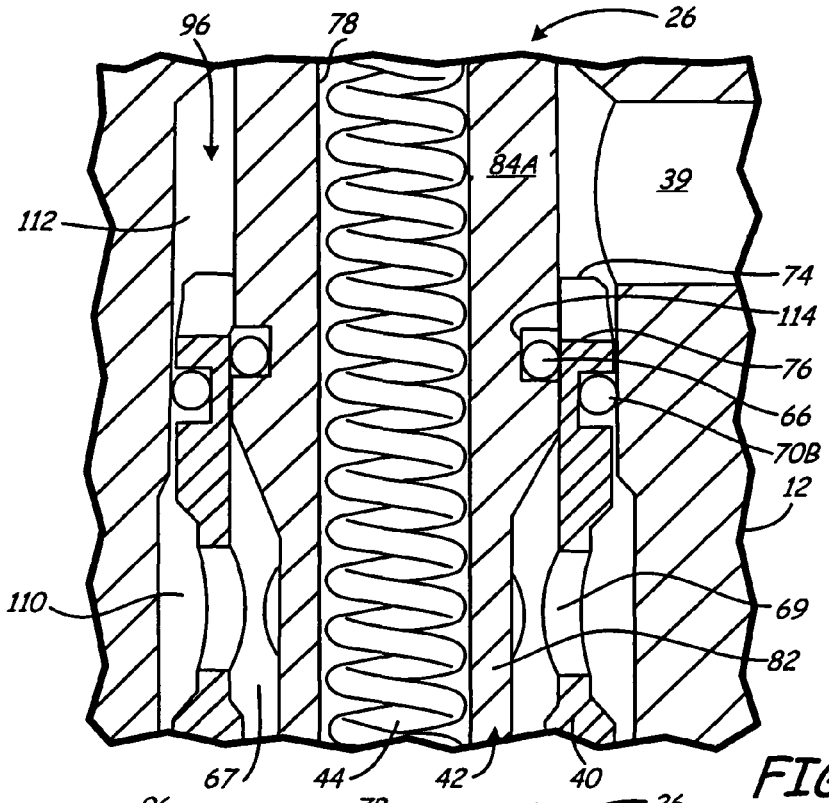
FIG. 6A shows a valve stem in a closed position within a castle-top valve cartridge as used in the hand-held fluid dispensing device of FIG. 5.

FIG. 6A shows an enlarged portion of valve 26 from FIG. 5 in which valve stem 42 is in a closed position within castle-top valve cartridge 40 to prevent fluid flow through valve 26. Valve 26 includes valve cartridge 40, valve stem 42 and valve spring 44. Valve spring 44 is inserted into spring bore 78 of valve stem 42. Valve stem 42 is inserted into receiving bore 67 of valve cartridge 40. Valve cartridge 40 is inserted into platform 12 at bore 96, which comprises lower portion 110 and upper portion 112. Upper portion 112 is in fluid communication with high-pressure fluid passage 39, while lower portion 110 is in fluid communication with low-pressure fluid passage 62 (FIG. 5). Upper portion 112 of bore 96 is sealed around valve stem 42 with seal 86A (FIG. 4). Lower portion 110 of bore 96 is sealed around cartridge 40 with seal 86B (FIG. 4). Valve cartridge 40 is sealed around valve stem 42 using seal 66. Specifically, in the fully closed position shown in FIG. 6A, valve stem 42 is pushed down into valve cartridge 40 by valve spring 44 such that valve seal 66 is positioned below embrasures 76 within seal channel 114. Thus, valve cartridge 40 engages the entire three-hundred-sixty degree perimeter of valve seal 66 to push seal 66 into valve channel 114.

Fluid from high-pressure fluid passage 39 enters upper portion 112 of bore 96 and surrounds sealing portion 84A of valve stem 42 and fills embrasures 76. Seal 66 prevents fluid from entering receiving bore 67, while seal 70B prevents fluid from traveling between platform 12 and cartridge 40. Seal portion 84A of stem 42 does not seal against bore 67 of cartridge 40 and fluid is permitted to enter seal channel 114, thus exposing seal 66 to pressure from the fluid within passage 39. Seal 66 is retained within seal channel 114 by the main body of valve cartridge 40, which compresses seal 66 to seal channel 114 and bore 67. Thus, fluid is prevented from entering bore 67 or lower portion 110 and ultimately low pressure passage 62. Trigger lever 20 (FIG. 5) is actuated to traverse valve stem 42 upward within bore 67 to push dispensing portion 82 into fluid communication with embrasures 76 and channel 39.

Figure 6B:
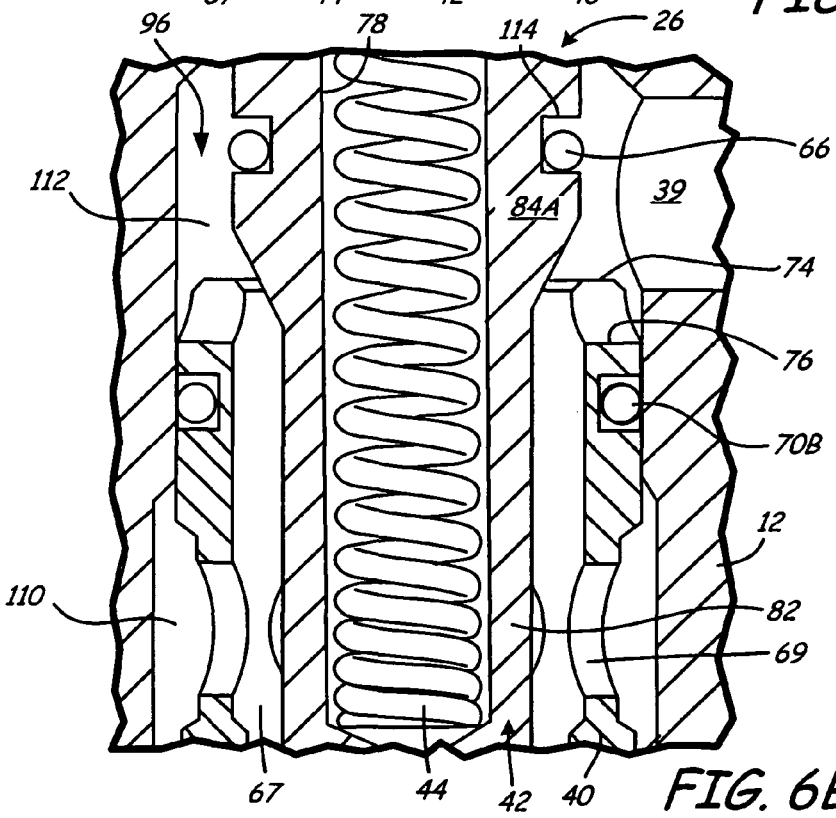
FIG. 6B shows a valve stem in an open position within a castle-top valve cartridge as used in the hand-held fluid dispensing device of FIG. 5.

FIG. 6B shows an enlarged portion of valve 26 from FIG. 5 in which valve stem 42 is in an open position within castle-top valve cartridge 40 to permit fluid flow through valve 26. In the open position, trigger lever 20 (FIG. 4) pushes valve stem 42 upward to compress valve spring 44 between platform 12 and valve stem 42. Valve stem 42 is displaced such that seal channel 114 and seal 66 are above both embrasures 76 and merlons 74, and dispensing portion 82 is positioned adjacent embrasures 76 and merlons 74. Seal 66 is not disposed about the interior perimeter of cartridge 40 and does not seal dispensing portion 82 from passage 39. Seal 70B maintains a seal between the exterior surface of cartridge 40 and upper portion 112 of bore 67, and seals 86A and 86B (FIG. 4) remain sealed with platform 12 and cartridge 40, respectively. Thus, dispensing portion 82 is open to discharge bores 69 and fluid from passage 39 is permitted to flow into the discharge port between valve stem 42 and cartridge 40, and ultimately low-pressure fluid passage 62 (FIG. 5).

FIG. 6B shows valve stem 42 fully, or nearly fully, opened such that the maximum amount of fluid from passage 39 is permitted to flow into bore 67. The change in position of valve stem 42 from FIG. 6A to FIG. 6B defines a stroke length of valve 26. Seal 66 is positioned away from cartridge 40 and the direction in which the fluid is driven to flow by the pressure differential between passage 39 and passage 62. In the open position, the sum of the forces acting upon seal 66 allows seal 66 to remain seated within seal channel 114. For example, the inherent elasticity of seal 66 pulls seal 66 inward toward valve stem 42. The forces from the high pressure fluid acting upon seal 66 produce inward forces that also push seal 66 into channel 114. The fluid also flows around seal 66 within channel 114 to surround seal 66 and produce outward pressure. However, since seal 66 is positioned away from the direction of flow of the fluid, the outward forces are not enough to overcome the inward forces generated by the fluid and seal 66. Seal 66 thus remains seated within seal channel 114. As valve stem 42 traverses the stroke length, it is possible under particular conditions that the fluid forces on seal 66 may overcome the elasticity of seal 66. For example, rapid actuation of valve stem 42 across the stroke length may cause seal 66 to expand from seal channel 114. Merlons 74 are, however, positioned to prevent seal 66 from unseating from channel 114 when fluid forces are great enough to overcome the elasticity of seal 66.

Figure 7:
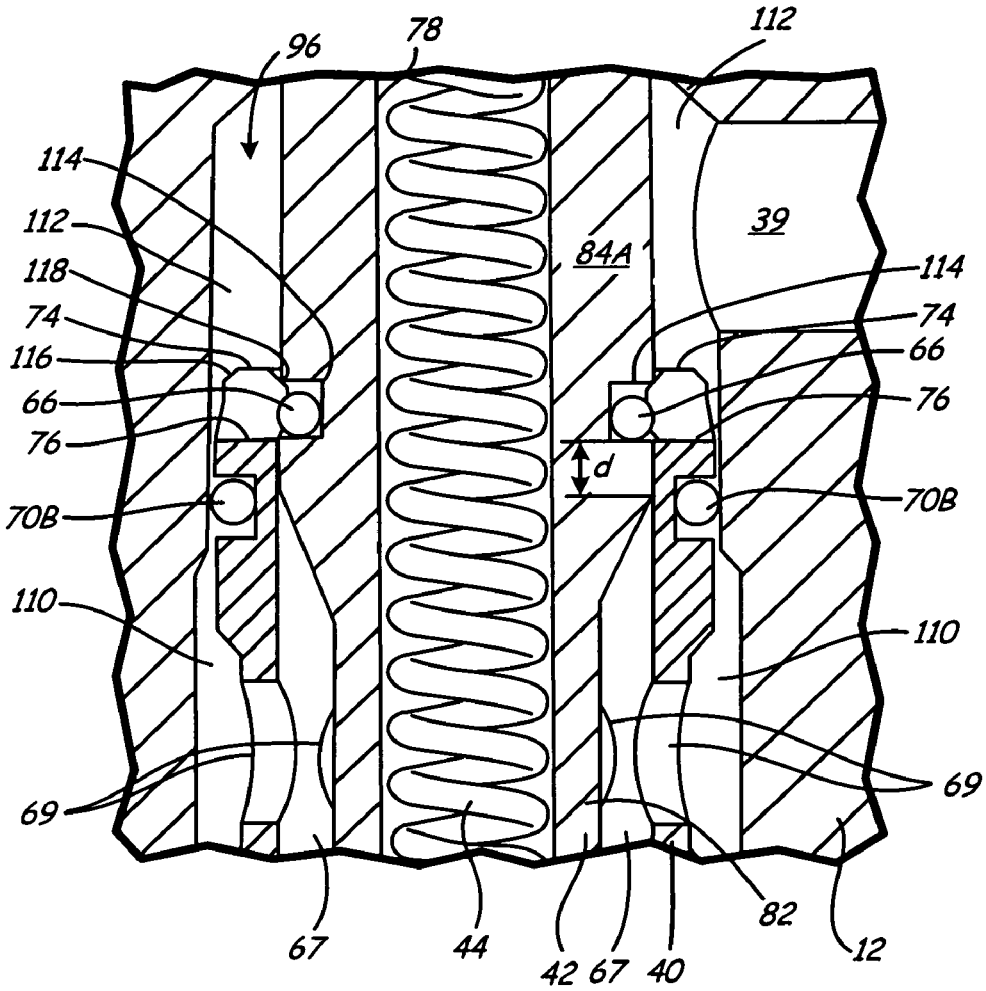
FIG. 7 shows the valve stem of FIGS. 5A and 5B in an intermediate position within the castle-top valve cartridge such that merlons restrain a valve seal within a seal channel on the valve stem, while embrasures permit fluid to pass around the valve seal.

FIG. 7 shows an enlarged portion of valve 26 from FIG. 5 in which valve stem 42 is in an intermediate position within castle-top valve cartridge 40, at a point just previous to dispensing portion 82 being opened to high-pressure fluid passage 39. In the intermediate position shown, seal channel 114 is positioned adjacent merlons 74. Thus, embrasures 76 prevent valve seal 66 from being continuously positioned adjacent the interior surface of cartridge 40. Thus, the seal between valve stem 42, valve seal 66 and valve cartridge 40 is partially broken and fluid is permitted underneath valve seal 66 through embrasures 76. As such, fluid begins to flow through valve 26 between valve stem 42 and valve cartridge 40. The pressure differential across seal 66 from fluid flow tends to overcome the elasticity of seal 66 and produce a net outward force on seal 66. Valve seal 66 is, however, positioned adjacent merlons 74 to prevent seal 66 from stretching under fluid pressure, becoming dislodged from seal channel 114, and being pushed down onto dispensing portion 82 as stem 42 continues through the stroke length. Merlons 74 counteract the outward fluid forces to restrain valve seal 66 within valve channel 114 until seal 66 is moved sufficiently upward out of the way of the fluid flow and dispensing portion 82 is fluidly connected with high-pressure fluid passage 39, such as shown in FIG. 6B. Thus, merlons 74 and embrasures 76 reduce the pressure differential across valve seal 66 during the transition of valve stem 42 from the fully opened position to the fully closed position. Specifically, merlons 74 restrain valve seal 66 until dispensing portion 82 is opened to embrasures 76.

Merlons 74 include outer chamfers 116 to facilitate insertion of valve cartridge 40 into bore 67. Within bore 67, valve cartridge 40 is disposed such that the end surface of cartridge 40 encompassing merlons 74 is approximately aligned with the perimeter of passage 39, and discharge bores 69 are disposed within lower portion 110. Lower portion 110 has a larger diameter than upper portion 112 to permit fluid to flow through bores 69. Merlons 74 also include inner chamfers 118 to facilitate sliding of valve stem 42 within bore 67, and valve channel 114 past merlons 74. Valve stem 42 is disposed within valve cartridge 40 such that dispensing portion 82 is aligned with discharge bores 69 and can be slid by trigger lever 20 to align with embrasures 76.

Embrasures 76 are deeper than the height of seal channel 114 to permit merlons 74 to enclose seal 66 within channel 114 and to permit fluid to travel underneath seal 66 to reach the interface between valve cartridge 40 and valve stem 42, thereby reducing the pressure differential across seal 66. Seal channel 114 is spaced from dispensing portion 82 of valve stem 42 a distance d, which is less than the height of merlons 74 such that merlons 74 provide restraint to seal 66 across the portion of the stroke length when bore 67 is initially opened to high-pressure fluid passage 39, e.g. when dispensing portion 82 first opens to embrasures 76 and fluid pressures tend to overcome elastic forces within seal 66. In other embodiments, seal channel 114 is spaced from dispensing portion 82 a distance greater than the height of merlons 74 such that seal 66 is pushed far away from the downward flow of the fluid entering bore 67 and its associated pressures at the portion of the stroke length when bore 67 is initially opened to high-pressure fluid passage 39. As dispensing portion 82 more fully opens bore 67 to passage 39, seal 66 is pushed further up into bore 96 away from the direction of flow and the associated pressures of the fluid, thus reducing the need for merlons 74. The height of merlons 74 and embrasures 76 are sized to restrain seal 66 near the bottom of and beneath passage 39, where the forces from the fluid act most severely on seal 66, before dispensing portion 82 opens to embrasures 76.

Merlons 74 and embrasures 76 prevent seal 66 from dislodging from seal channel 114. When valve stem 42 returns to the closed position, such as shown in FIG. 5A, seal 66 will thus again be properly seated within seal channel 114 and prevents fluid from leaking through valve 26. Thus, the precision with which flow meter 28 (FIG. 4) registers fluid flow is not compromised by leaked fluid. Merlons 74 and embrasures 76 also increase the sealing capabilities of valve 26 by permitting seal 66 to be fabricated from better performing materials. For example, seal 66 may be fabricated from a rubber O-ring. Rubber has high elasticity, which permits rubber seals to provide superior sealing capabilities due to their ability to deform and fill in gaps such as that between valve stem 42 and valve cartridge 40. The elasticity, however, more readily allows fluid pressure within valve 26 to displace seal 66 from seal channel 114. Merlons 74 provide restraint to seal 66 when valve stem 42 is opened, while the elasticity of seal 66 provides the sealing of bore 67 when valve stem 42 is closed. Thus, it becomes unnecessary to use harder durometer seals, which are less elastic and provide less sealing capability at low pressure differentials and low temperatures, for the sake of improving seal retention. Use of highly elastic seals, which is enabled by merlons 74, also permits less tight tolerances between valve stem 42 and valve cartridge 40, which facilitates manufacturing and reduces cost. Furthermore, the seal-retaining features also enable device 10 to be used with high fluid pressures. Although the benefits of the present invention have been described with respect to a castle-top valve cartridge having a crenelated edge, other embodiments comprise other types of seal-retaining features.

Figure 8:
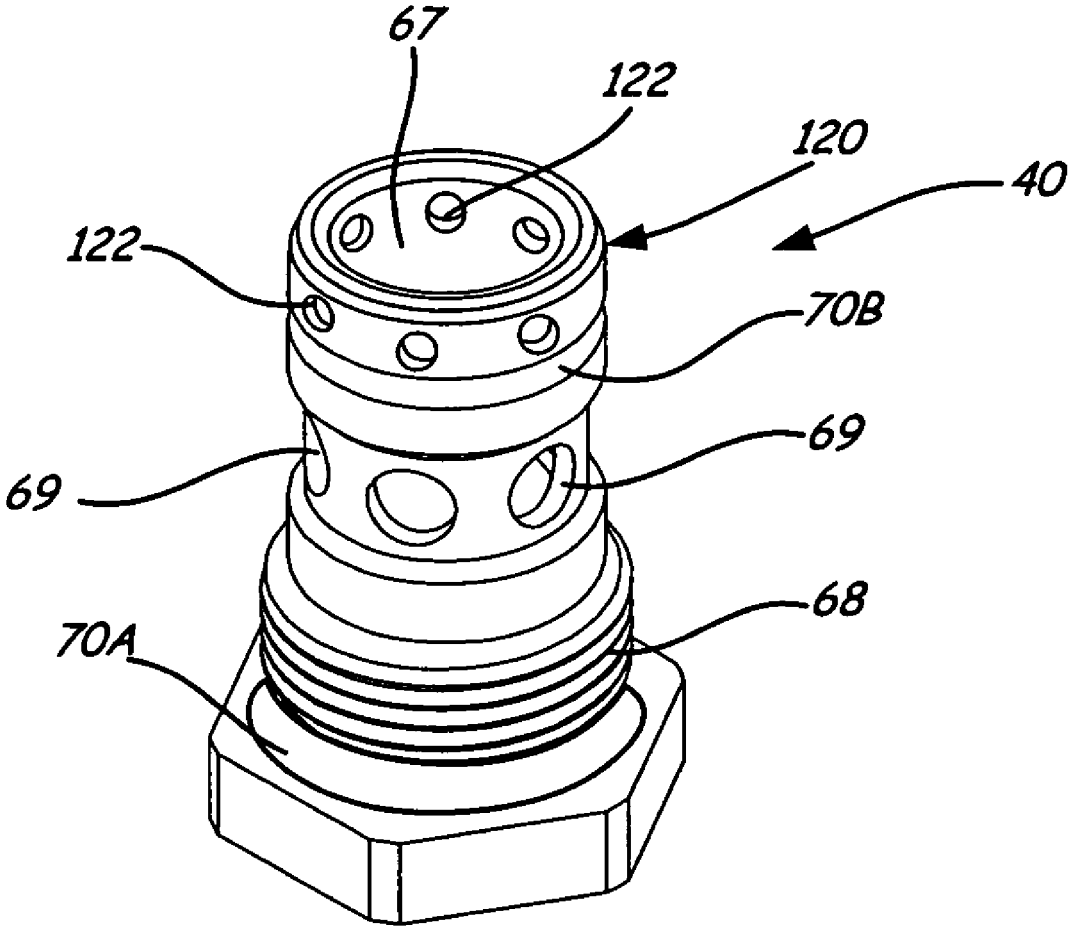
FIG. 8 shows a second embodiment of a valve cartridge of the present invention having a ported-top.

FIG. 8 shows a second embodiment of valve cartridge 40 of seal-retaining valve 26 of the present invention having ported-top 120 and bores 122. Valve cartridge 40 comprises similar features as that of valve cartridge 40 described in FIG. 4, such as a generally cylindrical body having receiving bore 67, exterior threads 68, discharge bores 69, cartridge seals 70A and 70B. However, castle-top 72 is replaced with ported-top 120. Ported-top 120 includes bores 122, which are formed into an end of the body of cartridge 40. In the embodiment shown, bores 122 comprise circular holes that form inlet passages into bore 67. Bores 122 are thus spaced by portions of the body of cartridge 40. Bores 122 perform a similar function as that of embrasures 76 in that they permit fluid to flow underneath seal 66, while the portions of the body of cartridge 40 projecting between bores 122 restrain radial outward expansion of seal 66, similar to merlons 74.

Although the present invention has been described with reference to preferred embodiments, workers skilled in the art will recognize that changes may be made in form and detail without departing from the spirit and scope of the invention.

The invention claimed is:

1. A valve comprising:
a valve cartridge comprising:
a cartridge body comprising:
first and second end walls; and
an elongate side wall extending between the first and second end walls;
a bore extending longitudinally through the cartridge body from the first end wall to the second end wall;
a plurality of intermittent inlet passages extending through the side wall to the bore near the first end wall, wherein the plurality of inlet passages form a crenelated edge at the first end wall; and
an outlet passage extending through the side wall to the bore between the first end wall and the second end wall;
a valve stem comprising:
an elongate body disposed within the cartridge body to close the bore near the first end wall and the second end wall;
a neck disposed at an intermediate portion of the elongate body and disposed adjacent the outlet passage; and
a seal channel circumscribing an exterior surface of the elongate body; and
a valve seal disposed within the seal channel to seal between the bore and the elongate body;
wherein the valve stem is configured to slide within the bore to fluidly connect the neck with the intermittent inlet passages, the intermittent inlet passages being configured to fluidly open the seal channel to the side wall while the seal is disposed within the bore.

2. The valve of claim 1 wherein the crenelated edge comprises:
a plurality of semi-circular scallops; and
a plurality of flanges disposed between the scallops.

3. The valve of claim 1 wherein the plurality of intermittent inlet passages are positioned to fluidly open the seal channel to the side wall until the neck is opened to the inlet passages as the seal channel moves past the inlet passages.

4. The valve of claim 3 wherein portions of the valve cartridge body between the plurality of intermittent inlet passages inhibit displacement of the seal from the seal channel until the neck is opened to the inlet passages.

5. The valve of claim 3 wherein a height of each of the plurality of intermittent inlet passages is approximately equal to a distance between the seal channel and the neck.

6. The valve of claim 3 wherein each of the plurality of inlet passages has a height greater than a height of the seal channel.

7. The valve of claim 1 wherein the intermittent inlet passages interrupt the seal formed between the bore, the valve seal and the elongate body as the seal channel moves past the inlet passages.

8. The valve of claim 1 wherein the intermittent inlet passages gradually reduce a pressure differential across the seal as the seal channel moves past the inlet passages.

9. The valve of claim 1 wherein the intermittent inlet passages permit fluid to flow underneath the valve seal to flow between the bore and the elongate body as the seal channel moves past the inlet passages.

10. A linearly actuated valve comprising:
a valve stem comprising:
a stem body having an outer surface;
a dispensing recess disposed about the outer surface; and
a seal channel disposed about the outer surface;
a valve seal disposed within the seal channel; and
a valve cartridge comprising:
a cartridge body having an elongate side surface;
a receiving bore extending longitudinally through the cartridge body, the outer surface of the stem body being configured to flushly ride within the receiving bore such that the dispensing recess forms a discharge port between the cartridge body and the stem body;
a discharge bore extending into the cartridge body to intersect the discharge port; and
a seal-retaining feature disposed near an end of the cartridge body, the seal-retaining feature comprising:
a non-uniform edge at the end of the cartridge body, the non-uniform edge comprising:
a flow passage configured to connect the side surface with the seal channel within the receiving bore; and
a retaining element disposed adjacent the flow passage and configured to retain the valve seal within the seal channel.

11. The linearly actuated valve of claim 10 wherein the seal-retaining feature comprises a crenelated-top at the end of the cartridge.

12. The linearly actuated valve of claim 11 wherein the crenelated-top comprises:
a plurality of embrasures comprising the flow passage; and
a plurality of merlons comprising the retaining element.

13. The linearly actuated valve of claim 10 wherein the valve stem is configured to slide within the receiving bore to fluidly connect the flow passage to the discharge bore through the discharge port, wherein the retaining element is configured to retain the valve seal within the seal channel until the discharge port opens to the flow passage.

14. A fluid dispensing meter comprising:
a platform having an internal passage comprising:
an upstream end for connecting to a pressurized fluid source; and
a downstream end having a dispensing tube;
a seal-retaining valve mounted to the platform between the upstream end and the downstream end, the seal-retaining valve comprising:
a valve cartridge comprising;
a cartridge body comprising:
first and second end walls; and
an elongate side wall extending between the first and second end walls;

a bore extending longitudinally through the cartridge body;

a plurality of intermittent inlet passages extending through the side wall to the bore, the plurality of intermittent inlet passages forming a crenelated edge at the first end wall; and an outlet passage extending through the side wall to the bore;

a valve stem comprising:

an elongate body disposed within the cartridge body to close the bore near the first end wall and the second end wall;

a neck on the elongate body disposed adjacent the outlet passage; and a seal channel circumscribing an exterior surface of the elongate body; and a valve seal disposed within the seal channel to seal between the bore and the elongate body;

wherein the valve stem slides within the bore to fluidly connect the neck with the intermittent inlet passages, which are configured to fluidly open the seal channel to the side wall while the valve seal is disposed within the bore;

a valve spring disposed between the valve stem and the platform to bias the seal-retaining valve to a closed position; and a trigger mounted to the platform and configured to actuate the valve stem within the valve cartridge to open the seal-retaining valve.

15. The fluid dispensing meter of claim 14 and further comprising:

meter electronics mounted to the platform, the meter electronics comprising a display, a user interface, and communication circuitry configured to monitor fluid flow through the dispensing meter;

a metering device disposed within the internal passage and connected to the meter electronics to measure volumetric fluid flow through the internal passage; and a trigger release mechanism connected to the meter electronics and the trigger, and configured to prevent the trigger from actuating the valve stem.

16. A valve comprising:

a valve cartridge comprising:

a cartridge body comprising:

first and second end walls; and an elongate side wall extending between the first and second end walls;

a bore extending longitudinally through the cartridge body from the first end wall to the second end wall;

a plurality of intermittent inlet passages extending through the side wall to the bore near the first end wall; and an outlet passage extending through the side wall to the bore between the first end wall and the second end wall;

a valve stem comprising:

an elongate body disposed within the cartridge body to close the bore near the first end wall and the second end wall;

a neck disposed at an intermediate portion of the elongate body and disposed adjacent the outlet passage; and a seal channel circumscribing an exterior surface of the elongate body; and a valve seal disposed within the seal channel to seal between the bore and the elongate body;

wherein the valve stem is configured to slide within the bore to fluidly connect the neck with the intermittent inlet passages, the intermittent inlet passages being configured to fluidly open the seal channel to the side wall while the seal is disposed within the bore; and wherein the plurality of intermittent inlet passages are positioned to fluidly open the seal channel to the side wall until the neck is opened to the inlet passages as the seal channel moves past the inlet passages.

17. The valve of claim 16 wherein portions of the valve cartridge body between the plurality of intermittent inlet passages inhibit displacement of the seal from the seal channel until the neck is opened to the inlet passages.

18. The valve of claim 16 wherein a height of each of the plurality of intermittent inlet passages is approximately equal to a distance between the seal channel and the neck.

19. The valve of claim 16 wherein each of the plurality of inlet passages has a height greater than a height of the seal channel.

20. The valve of claim 16 wherein the plurality of inlet passages form a ported end at the first end wall.

21. The valve of claim 20 wherein the ported end comprises a plurality of circular bores.

22. The valve of claim 16 wherein the plurality of inlet passages form a crenelated edge at the first end wall wherein the crenelated edge comprises:

a plurality of semi-circular scallops; and a plurality of flanges disposed between the scallops.

* * * * *